United States Patent [19]

Frinzel

[11] Patent Number: 4,966,122

[45] Date of Patent: Oct. 30, 1990

[54] BYPASS THROTTLE CONTROL FOR A MOTOR VEHICLE

[75] Inventor: Udo Frinzel, Oberkotzau, Fed. Rep. of Germany

[73] Assignee: Siemens Aktiengesellschaft, Berlin and Munich, Fed. Rep. of Germany

[21] Appl. No.: 497,928

[22] Filed: Mar. 23, 1990

[30] Foreign Application Priority Data

Apr. 13, 1989 [EP] European Pat. Off. ..... 89106653.2

[51] Int. Cl.[5] ..... F02M 3/06

[52] U.S. Cl. ..... 123/585; 123/339

[58] Field of Search ..... 123/585, 586, 587, 339

[56] References Cited

U.S. PATENT DOCUMENTS

| | | | |
|---|---|---|---|
| 3,327,694 | 6/1967 | Ariga | 123/339 |
| 3,575,390 | 4/1971 | Bickhaus et al. | 261/41 |
| 4,146,594 | 3/1979 | Raud | 123/339 |
| 4,201,169 | 5/1980 | Michassouridis | 123/124 |
| 4,401,074 | 8/1983 | Horiuchi et al. | 123/339 |
| 4,433,661 | 2/1984 | Hartel et al. | 123/339 |
| 4,438,049 | 3/1984 | Ammons | 261/42 |
| 4,474,152 | 10/1984 | Horiuchi et al. | 123/339 |
| 4,870,944 | 10/1989 | Matsumoto et al. | 123/339 |

FOREIGN PATENT DOCUMENTS

| | | |
|---|---|---|
| 1253864 | 11/1971 | United Kingdom . |
| 1480011 | 7/1977 | United Kingdom . |

*Primary Examiner*—Andrew M. Dolinar
*Assistant Examiner*—M. Macy
*Attorney, Agent, or Firm*—Hill, Van Santen, Steadman & Simpson

[57] ABSTRACT

The invention is directed to a bypass throttle control for a motor vehicle. A cross section of a critical opening of the bypass throttle control past which a marginal edge of a throttle valve moves during its opening motion is designed such that no limiting edge of the opening that extends parallel to its marginal edge is present below an intermediate position of the throttle valve. As a result thereof, whistling noises that otherwise occur in integrated bypass throttle controls and an undesired deformation of a control characteristic curve are prevented.

8 Claims, 1 Drawing Sheet

BYPASS THROTTLE CONTROL FOR A MOTOR VEHICLE

BACKGROUND OF THE INVENTION

The present invention is directed to a bypass throttle control for a motor vehicle having a throttle valve connector, a throttle valve pivotally seated in the throttle valve connector, connecting openings in a wall of the throttle valve connector for the connection of an idling control, these connecting openings located on either side of the throttle valve in reference to a flow direction for a throttle valve in a closed position.

SUMMARY OF THE INVENTION

An object of the present invention is to provide a throttle valve connector having connecting openings for the connection of an idling control as short as possible.

This object is achieved by having the connecting openings for the connection of the idling control located extremely close to the closed position of the throttle valve. Due to the novel design of the limiting edges of the connecting openings relative to the marginal edge of the throttle valve, disturbing noises are not produced and any undesired deformation of the control characteristic curve is avoided.

The object of the present invention is achieved by one connecting opening of the two openings being a critical opening and located at least partly in a section of the wall that is limited by the closed position and by an intermediate position of the throttle valve; the intermediate position being at a maximum of 30 ° from the closed position; and the critical opening having an open cross section such that the throttle valve overruns no limiting edge of this open cross section that extends parallel to a marginal edge of the throttle valve during opening motion of the throttle valve between the closed position and the intermediate position.

In one embodiment of the present invention the open cross section of the critical opening is a rectangular area less the area of a triangle, whereby the rectangular area has two limiting edges perpendicular to a longitudinal axis of the throttle valve connector and one side of the triangle is that limiting edge of the rectangular area that lies closest to the closed position of the throttle valve.

In another embodiment of the present invention the open cross section of the critical opening is a rectangular area less the area of a circular segment, whereby the rectangular area has two limiting edges perpendicular to a longitudinal axis of the throttle valve connector and the straight-line edge of the circular segment is that limiting edge of the rectangular area lying closest to the closed position of the throttle valve.

The critical opening is the intake opening of the idling control and the other connecting opening of the two openings is a discharge opening. A shield is arranged in the throttle valve connector so that all limiting edges of the discharge opening lie in the flow shadow thereof with respect to a main air stream flow via the throttle valve. The discharge opening has a circular cross section and the shield is a tube section plugged in the discharge opening, the tube section projecting into the throttle valve connector, whereby that part projecting into the throttle valve connector is cut off at an angle.

The present invention is based on the perception that problems arise when the limiting edges of one of the openings of the idling bypass control that extend parallel to the marginal edge of the throttle valve lie opposite the throttle valve at a slight distance for small throttle valve angles.

The reason for the deformation of the control characteristic curve is due to edges that extend parallel to one another. When, namely, the throttle valve overruns or overshoots such a parallel edge, then the effective throttle cross section of the throttle valve connector changes abruptly due to the added or subtracted area across the opening cross section of the idling bypass throttle control via which additional air can flow. This produces the deformation of the control characteristic curve in the region of the opening toward higher values of air throughput, which is detrimental to achieving an optimally steady course of the control characteristic.

The solution of the present invention therefore provides that the opening cross section is designed such that no limiting edges that extend parallel to the marginal edge of the throttle valve are present at the opening from an intermediate position to a closed position of the throttle valve. For position of the throttle valve above the intermediate position, the gap between the marginal edge of the opened throttle valve and the wall of the throttle valve connector is already large enough that whistling noises can no longer occur. The air throughput rate is then also already high enough that the effects across the opening cross section of the idling bypass throttle control can no longer have any noticeable influence on the control characteristic curve. The relative position of the intermediate position depends on the shape and dimensions of the throttle valve connector, of the throttle valve, as well as of the opening cross section of the idling filling control and is calculated on the basis of trials. It amounts to a maximum of 30°.

BRIEF DESCRIPTION OF THE DRAWINGS

The features of the present invention which are believed to be novel, are set forth with particularity in the appended claims. The invention, together with further objects and advantages, may best be understood be reference to the following description taken in conjunction with the accompanying drawings, in the several figures in which like reference numerals identify like elements, and in which:

DESCRIPTION OF THE PREFERRED EMBODIMENT

Figure 1:
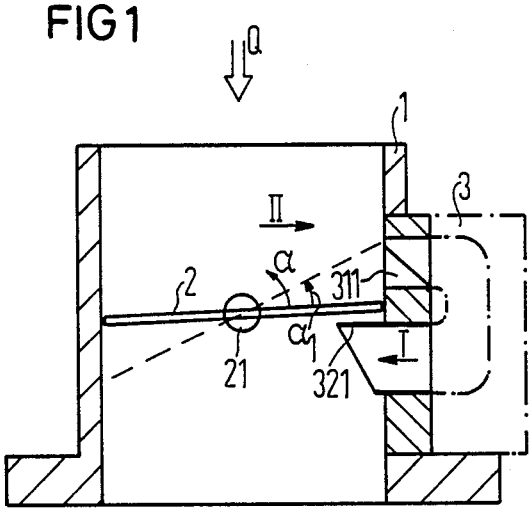
FIG. 1 is a cross section through a throttle valve connector having an intake and discharge opening for an integrated idling control.

FIG. 1 shows a vertical section through a throttle valve connector 1 that is introduced into the intake train (not shown) of an internal combustion engine. A throttle valve 2 is rotatably seated in the throttle valve connector 1. The throttle valve 2 is shown in its closed position, i.e., given a throttle valve angle $\alpha$ equal to zero degrees. It is rigidly connected to an axle 21 via which, proceeding from the closed position of $\alpha=0°$, it can be externally opened in a counter-clockwise direction as illustrated by the arrow.

An idling control 3 is directly flanged to the throttle valve connector 1, an appropriate air sub-stream T being capable of being regulated via this idling control 3 for a closed throttle valve 2 when the internal combustion engine is idling.

Figure 2:
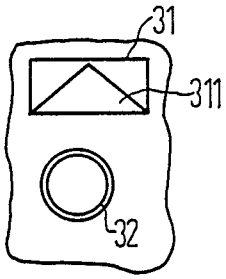
FIG. 2 is a plan view of the intake and discharge openings in the direction of the arrow II in FIG. 1.

An intake opening 31 and a discharge opening 32 of the idling control 3 are shown in FIG. 2 which is a plan view in the direction of the arrow II in FIG. 1. Surrounding parts have been omitted. The cross sectional area of the intake opening 31 is a retangular area less the area of a triangle that is formed by a member 311 introduced into the intake opening 31. The member 311 is flattened in the direction toward the inside of the idling bypass throttle control in order to impede the air sub-stream T as little as possible.

When the throttle valve 2 is opened, it reaches the lower limiting edge of the rectangular area of the intake opening 31 at a throttle valve angle $\alpha$ of approximately 10°. If the member 311 were not present, then the marginal edge of the throttle valve and the lower limiting edge of the intake opening 31 would be parallel relative to one another. The air streaming through the small air gap between the two edges for such a small throttle valve angle $\alpha$ would then lead to whistling noises. Moreover, given further opening of the throttle valve 2, a large throttle cross section across the intake opening 31 would abruptly result after the parallel limiting edge of the intake opening 31 is passed.

These two effects, however, are prevented by the member 311. The shape (triangular in FIG. 2) of the member 311 and the opening cross section of the intake opening 31 guarantees that the throttle valve 2 does not pass any parallel edges during its further opening motion. The throttle valve 2 overruns a minimum, parallel limiting edge only at the apex of the triangle. Due to its "punctiform length" and due to the large air gap between the marginal edge of the throttle valve 2 and the opening cross section that is thereby present, this parallel limiting edge at the apex of the triangle has no effect.

The upper limiting edge of the intake opening 31 in this case already lies above a throttle valve angle of $\alpha_1$. This defines an intermediate position of the throttle valve 2 above which the influence of a parallel limiting edge of the intake opening 31 does not have any effect.

The cross section of the intake opening 31 can actually have any arbitrary shape. It must merely be assured that the throttle valve 2 does not overrun any parallel limiting edges in the region of small throttle valve angles.

As may be seen in FIGS. 1 and 2, the discharge opening 32 has a round cross section. It is formed by a tube section that is plugged in a bore of the wall of the throttle valve connector 1, projects into the interior of the throttle valve connector 1 and, as may be seen in FIG. 1, is cut of at an angle. The plane of the cut thereby forms an acute angle with the longitudinal axis of the throttle valve connector, this acute angle having its apex directed against the air stream. A shield, in whose flow shadow lie all limiting edges of the outflow opening 32, thereby arises vis-a-vis the main air stream Q. The air sub-stream T arriving via the idling control 3 can thus flow more easily into the throttle valve connector 1 and the air throughput rate of the idling control 3 is improved.

Figure 3:
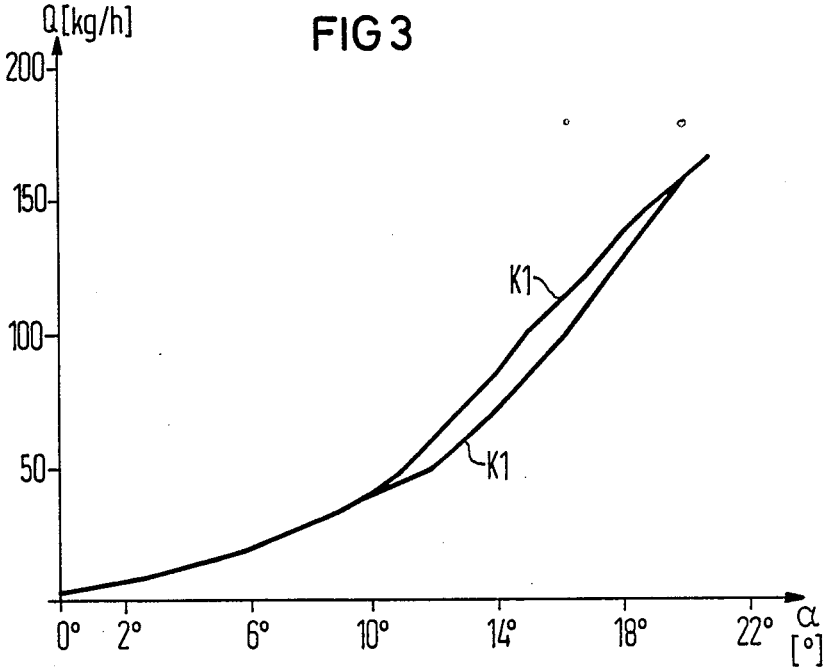
FIG. 3 is a graph comparing two control characteristic curves with and without the means of the present invention.

FIG. 3 is a graph depicting two control characteristic curves K1, K2. The respective main air stream Q measured in kilograms per hour is entered as a function of the throttle valve angle $\alpha$ in degrees.

The control characteristic curve K1 is representative of a throttle valve connector which does not have the means of the present invention, i.e., without the member 311 and the tube section 321. During its opening motion, the throttle valve 2 reaches the lower, parallel limiting edge of the intake opening 31 at an angle $\alpha=20°$. The air throughput characteristic K1 in FIG. 3, consequentially, shows a deformation toward higher values of the main air stream Q in this angular range from 10°–20°. The reason for this is the lower limiting edge of the intake opening 31 that extends parallel and the abrupt change of the throttle cross section associated therewith when this limiting edge is overrun.

The control characteristic curve K2, by contrast, is representative of a throttle valve which has the member 311 and the tube section 321. It shows that avoiding limiting edges of the intake opening 31 that lie parallel to the marginal edge of the throttle valve yields a uniform, parabolically proceeding control characteristic curve as would also present without the presence of an integrated idling control 3.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Bypass throttle control for a motor vehicle having a throttle valve connector with a throttle valve pivotally seated in the throttle valve connector and connecting openings in a wall of the throttle valve connector for the connection of an idling control, these connecting openings located on either side of the throttle valve in reference to a flow direction for a throttle valve in a closed position, comprising: one connecting opening of the two openings being a critical opening and the other opening being a discharge opening, said critical opening located at least partly in a section of the wall that is limited by the closed position and by an intermediate position of the throttle valve; the intermediate position being at a maximum of 30° from the closed position; and the critical opening having an open cross section such that the throttle valve overruns no limiting edge of this open cross section that extends parallel to a marginal edge of the throttle valve during an opening motion of the throttle valve between the closed position and the intermediate position.

2. The bypass throttle control according to claim 1, wherein the open cross section of the critical opening is a rectangular area less than the area of a triangle, whereby the rectangular area has two limiting edges perpendicular to a longitudinal axis of the throttle valve connector and one side of the triangle is that limiting edge of the rectangular area that lies closest to the closed position of the throttle valve.

3. The bypasss throttle control according to claim 1, wherein the open cross section of the critical opening is a rectangular area less the area of a circular segment, whereby the rectangular area has two limiting edges perpendicular to a longitudinal axis of the throttle valve connector and a straight-line edge of the circular segment is that limiting edge of the rectangular area lying closest to the closed position of the throttle valve.

4. The bypass throttle control according to claim 1, wherein the critical opening is an intake opening of the idling control.

5. The bypass throttle control according to claim 4, wherein a shield is arranged in the throttle valve connector, so that all limiting edges of the discharge opening lie in a flow shadow thereof with respect to a main air stream flowing via the throttle valve.

6. The bypass throttle control according to claim 5, wherein the other connecting opening of the two openings is a discharge opening and wherein the discharge opening has a circular cross section and the shield is a tube section plugged in the discharge opening, said tube section projecting into the throttle valve connector, that part of the tube secton projecting into the throttle valve connector being cut off at an angle.

7. Bypass throttle control for a motor vehicle having a throttle valve connector with a throttle valve pivotally seated in the throttle valve connector and at least two connecting openings in a wall of the throttle valve connector for the connection of an idling control, these connecting openings located on either side of the throttle valve in reference to a flow direction for a throttle valve in a closed position, comprising: one connecting opening of the two openings being a critical opening and located at least partly in a section of the wall that is limited by the closed position and by an intermediate position of the throttle valve; the intermediate position being at a maximum of 30° from the closed position; and the critical opening having an open cross section such that the throttle valve overruns no limiting edge of this open cross section that extends parallel to a marginal edge of the throttle valve during an opening motion of the throttle valve during an between the closed position and the intermediate position, the open cross section of the critical opening being a rectangular area less the area of a triangle, whereby the rectangular area has two limiting edges perpendicular to a longitudinal axis of the throttle valve connector and one side of the triangle is that limiting edge of the triangular area that lies closest to the closed position of the throttle valve.

8. Bypass throttle control for a motor vehicle having a throttle valve connector with a throttle valve pivotally seated in the throttle valve connector and at least two connecting openings in a wall of the throttle valve connector for the connection of an idling control, these connecting openings located on either side of the throttle valve in reference to a flow direction for a throttle valve in a closed position, comprising: one connecting opening of the two openings being a critical opening which is an intake opening of the idling control and located at least partly in a section of the wall that is limited by the closed position and by an intermediate position of the throttle valve; the intermediate position being at a maximum of 30° from the closed position; and the critical opening having an opening cross section such that the throttle valve overruns no limiting edge of this open across section that extends parallel to a marginal edge of the throttle valve opening motion of the throttle valve between the closed position and the intermediate position; the other connecting opening of the two openings being a discharge opening having a circular cross section; and a shield arranged in the throttle valve connector, so that all limiting edges of the discharge opening lie in a flow shadow thereof with respect to a main air stream flowing via the throttle valve, the shield being a tube section plugged in the discharge opening, said tube section projecting into the throttle valve connector, that part of the tube section projecting into the throttle valve connector being cut off at an angle.

* * * * *